United States Patent [19]

Semon et al.

[11] 4,304,031

[45] Dec. 8, 1981

[54] AESTHETIC AND STRUCTURAL TRIM STRIP FOR CASKETS

[75] Inventors: Joseph R. Semon, Dalton, Pa.; Paul W. McCombs, Connersville, Ind.

[73] Assignee: Casket Shells Inc.

[21] Appl. No.: 135,293

[22] Filed: Mar. 31, 1980

[51] Int. Cl.[3] ..... A61G 17/00

[52] U.S. Cl. ..... 27/10

[58] Field of Search ..... 27/10, 2, 5, 6

[56] References Cited

U.S. PATENT DOCUMENTS

| | | | |
|---|---|---|---|
| 1,989,962 | 2/1935 | Zinser et al. | 27/10 X |
| 2,213,506 | 9/1940 | Thoresen | 27/10 |
| 2,594,580 | 4/1952 | Paul | 27/10 |
| 3,531,837 | 10/1970 | Cherry | 27/10 |
| 4,195,394 | 4/1980 | Semon | 27/10 |

*Primary Examiner*—John D. Yasko

*Attorney, Agent, or Firm*—Kane, Dalsimer, Kane, Sullivan & Kurucz

[57] ABSTRACT

A tack welded joint for a metal casket is covered by a trim strip following the contour of the shell along a length of the joint. An adhesive tape interposed between the strip and the shell overlies the joint in cooperating in releasably coupling the trim strip to the shell and provide a hermetic seal. Screws extending through the trim strip and the joint cooperating in strengthening the shell in this location.

24 Claims, 8 Drawing Figures

FIG. 3A
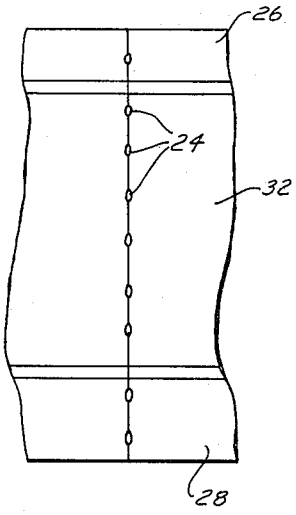
FIG. 3B
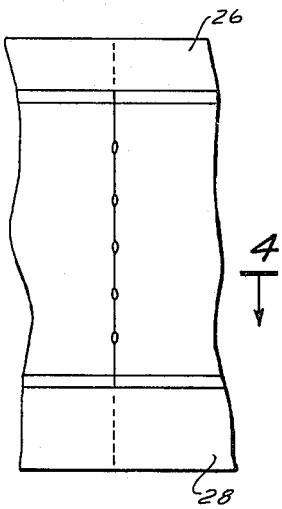
FIG. 3C
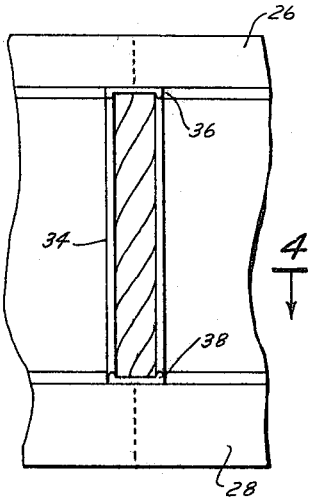
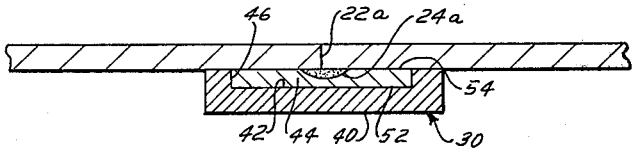
FIG. 4
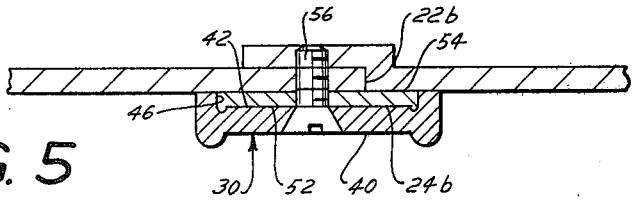
FIG. 5
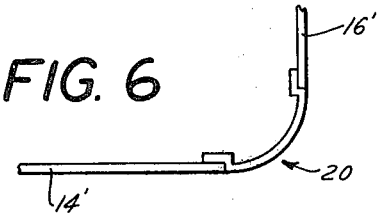
FIG. 6

AESTHETIC AND STRUCTURAL TRIM STRIP FOR CASKETS

BACKGROUND OF THE INVENTION

In the manufacture of metal caskets, and, particularly, caskets made of various grades of sheet steel or panelling, a relatively large number of manipulative steps are required, many of which necessitate the intervention of a considerable amount of manual labor. Consequently, the manufacturing cost of metal caskets is relatively high and is increasing at an alarming rate in view of the increase in prices of steel and precious metals as well as the increase in the cost of labor. Accordingly, it would be of extreme benefit to the industry to reduce the cost of casket manufacture by minimizing the various steps in the manufacturing process, and, of course, reducing the extent of intervention of manual labor.

Normally, when manufacturing metal caskets of steel, sheets and panels of suitable dimensions will be subjected to stamping operations in arriving at desired component configuration. In general, the stamped casket parts include a cap or lid, the side and end panels as well as the bottom. The casket shells will either have round ends or square ends. In the case of round end casket shells, the end panels have rounded corner sections; or, on the other hand, rounded corner pieces may be utilized in joining the side and end panels. Towards this end, the side and end panels will be initially tack welded to one another and squared; or on the other hand, they may be tack welded to the selected corner piece and squared. After squaring, the bottom, sides and end panel will be welded to one another. Anywhere from approximately 7 to 12 tack welds will be applied at the corner joints. This joint may be defined by a butt connection but, normally, with the end panels having rounded end sections the joint will be created by an overlapping of the adjacent edges. In such casket shell construction, it is necessary to apply a weld at each joint between the end sections and the side panels and consequently a total of four welds, with each weld being as long as the casket shell is tall or deep. These welds are usually made on the outside of the shell and due to the various contours of the shell are difficult and time consuming to grind or finish to a satisfactory appearance.

The welded joints will be subjected to a grinding operation followed by buffing and fine finishing to obtain the desired aesthetic appearance. The cap or lid is then assembled; and, following assembly, the entire casket is then passed through a cleaning operation followed by an application of primer and paint to obtain the appropriate decorative appearance. Selected hardware for both the exterior and interior is applied and the interior is suitably trimmed with liners, cloth and other materials.

SUMMARY OF THE INVENTION

The principal objects of the present invention is to eliminate a major part of the welding and finishing operations at each of the aforementioned joints following the initial tacking and squaring operation. In this manner, there is a considerable saving of time that would otherwise be required for welding and finishing the joints, as well as a savings of labor for these operations.

Another object is to provide at each joint, a seal adapted to overly and accommodate the tack welds and provide a hermetic seal at this location to thereby render it water and moisture proof.

A further object of the invention is to provide a trim strip of a decorative nature that conceals a structural weld necessary in the fabrication of a casket shell and that only conceals the unground weld but enhances or compliments the appearance of the finished product. The present invention is particularly adapted to casket shells having one-piece round end sections having integral corner radii that are adapted to be coupled to straight side panels to make the four sides of the round corner type shell.

Still another object is to provide an injection molded plastic trim strip of the foregoing type which advantageously eliminates the need to grind off or finish a weld in most of the contoured areas of the joint of a rounded end casket shell construction, at which only strategically located tack welds need be employed.

A still further object is to provide a tack welded joint of the foregoing type between casket shell end sections and side panels, which is effectively rendered hermetically sealed by sealing means forming part of the trim strip, with the trim strip being secured to the casket side with at least two screws which extends through the lap joint between the end section and side panel thereby further contributing to the securement of these casket shell parts to one another.

Another important object is to provide a foam tape for use with the trim strip of this invention which has pressure sensitivity on each side face thereof to permit the tape to stick or adhere to the inner faces of the trim strip and also to the surfaces forming the joint of the casket shell over which the trim strip is applied; and consequently the foam tape facilitates the securement of the trim strip over the joint during the assembly process and prior to final securement by screws in the case of a lap joint thereby minimizing the danger of the trim strip becoming disassociated from the casket shell by falling to the floor or other surface and becoming damaged in appearance. In addition, the foam tape minimizes the flexing of the trim strip relative to the shell, by providing a cushioning layer in conjunction with the double adhesive face, thereby reducing vibration, noise and chatter and the possible creation of zones of weakening due to undue flecture of the trim strip.

Still another important object is to provide a foam tape of the foregoing type which contributes to offsetting the effects of heat and cold and consequently expansion and contraction at the joint, and resulting distortion of either the trim strip or the associated parts of the casket shell relative to one another. In view of the multiple contours of a number of the trim strips which are designed to mate or mesh with comparable contours on the casket shell, changing one of such contours would effect the others and the mating relationship between trim strip and shell, which contingency is effectively offset as a result of the use of the foam tape and particularly the double adhesive face and the securement provided thereby.

A further important object is to provide a trim strip for a tack welded joint with a foam tape interposed between the strip and the joint which serves to seal the joint and render the joint solid and permits the elimination of a completely welded joint and permits merely the use of positioning the tack welds only, which are effectively applied at stress points only, which in most instances will only total four; and consequently air-tight moisture-proof seal at the joint between end sections and side panels of a casket shell is attained thereby preventing possible damage of the interior of the casket.

Yet another object is to provide a joint of the foregoing type which eliminates grinding, polishing, buffing or otherwise finishing of the major part of the joint while rendering an acceptable appearance of the type provided in the prior art.

Yet another important object is to provide a trim strip that compliments the other hardware utilized on the casket and adds an appearance of strength and creates the impression that the casket is built sturdier and stronger, thereby enhancing the marketability and saleability of the casket. The trim strip in combination with the foam tape provides a cushioning and dampening effect against vibration, thereby adding to the impression that the casket is built sturdier.

A most important object is to effectively reduce the time required in assembling and finishing the casket shell, and in specific applications where four trim strips with doubled sided adhesive tape are utilized in a manner discussed in the above, there were realized savings of approximately 45 minutes in assembly, approximately 45 minutes in finishing with attendant savings in cost of upwards of $18–$20 per casket.

In casket shells which do not deploy round end sections, but rather straight end and side panels thereby requiring four corner pieces to be welded to each of the adjacent end and side panels and consequently eight tack welded joints over which the combination of trim strip and foam tape assembly is applied as discussed in the above, the savings in time, labor and money is increased by a factor of at least 2.

The double adhesive foam tape of the foregoing type assures that the strip will follow and maintain the contour of the shell and consequently assure that the appearance of the joint assumes the most aesthetic appearance at all times without any distortion of the contour of this trim strip, to detract from the appearance of the casket.

The strategically located screws that secure the trim strip to the overlapping metal at the joint not only serve to reduce the number of tack welds required, but in a number of contemplated instances, may even serve to replace the weld entirely, and, in this connection, if needed, more screws may be utilized to secure this joint.

Other objects and advantages will become apparent from the detailed description which is to be taken in conjunction with the accompanying drawings.

BRIEF DESCRIPTION OF THE DRAWINGS

FIGS. 3A–3C are a fragmentary side elevational view showing the tack welding of a joint, finishing of the top and bottom rail portion of the joint and the trim strip then applied over the joint;

FIG. 4 is an enlarged cross-sectional view taken along the line 4—4 of FIG. 3 showing a butt welded connection between the side and end panels;

FIG. 5 is a similar cross-sectional view showing an overlap tack welded connection between the side and end panels; and FIG. 6 is a cross-sectional view showing the utilization of a separate corner piece for facilitating the connection between the straight side and end panels with the teachings of the present invention incorporated at each of the welded joints.

DETAILED DESCRIPTION OF THE PREFERRED EMBODIMENT

Figure 1:
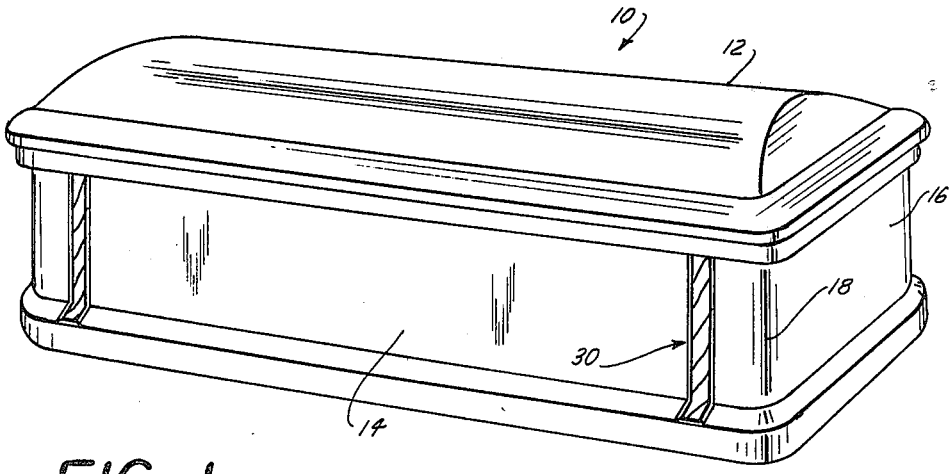
FIG. 1 is a perspective view of a metal casket incorporating the teachings of the present invention, but not including any of the remaining decorative or traditional hardware.
Figure 2:
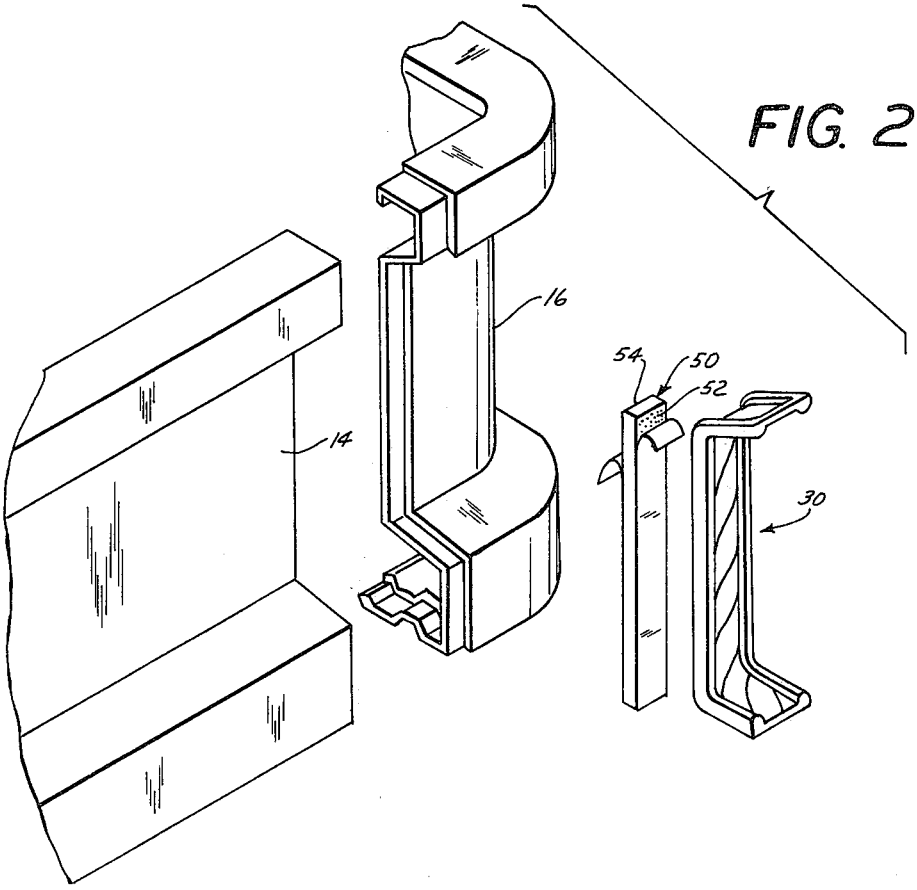
FIG. 2 is an enlarged fragmentary exploded perspective view of a corner of the casket showing a side panel and end panel having rounded corners with the trim strip and sealing and adhering tape of the present invention spaced thereform and prior to tack welding the side and end panels and installation of the trim strip and sealing tape over the joint and particularly the tack welds.

In the drawings, casket 10 of selected metal, such as bronze, copper or the various grades of steel or zinc coated steel is shown without conventional, decorative, functional or traditional hardware other than that proposed by the teachings of the present invention. The casket 10 may be of any one of many different styles and variety including the full and half couch designs. Towards this end, a typical casket will include a cap or lid 12, opposed side panels 14 and end panels 16, as well as a base or bottom (not shown).

As shown, the side panels 14 may be straight with the end panels 16 provided with rounded corner sections 18 or each end panel 16 may be straight as shown in FIG. 6 with a corner piece 20 employed to connect the panels. The connection between the rounded corner end panels 16 and side panels 14 as well as the connection between the corner piece 20 and the straight end panels 16′ and side panels 14′ may be a butt welded connection as shown in FIG. 4 or it may be an overlapping edge connection which is tack welded together as shown in FIG. 5.

In the normal course of securing and squaring the side panels 14 with the end panels 16, a number of tack or spot welds 26 are normally applied at strategic stress points. The present invention envisions applying a complete weld along the joint **24*a* and 24*b* defined by the top rail 26 and the bottom rail 28**. At these locations the complete weld provides a hermetic connection which is later subjected to a grinding operation followed by buffing and fine finishing to obtain the desired aesthetic appearance. In most instances, there is no visible appearance of a connection or joint at this location, particularly after the casket shell has been primed and painted.

After the tack welding and squaring operation, the present invention contemplates the application and installation of trim strips 30 over the joints **22*a* and 22*b* intermediate the top rail 26 and bottom rail 28 at anyone of a number of stages of the ensuing manufacturing and assembly procedures. These trim strips 30 may be conveniently injection molded of suitable resinous material and to provide the desired aesthetic and decorative affect and compliment the remaining hardware applied to the casket 10, may be suitably finished. For example, the finish may be obtained by the application of a metalized surface to the exposed portions of the strip, which in addition conveys the impression of strength and rigidity along that portion of the joint 22*a* and 22*b* which the trim strip is applied. Each of the trim strips 30 is fabricated to closely follow the contour of the casket shell, particularly the intermediate section 32 and in a majority of instances the adjacent sectors of the top rail 26 and bottom rail 28** that are inaccessible and somewhat difficult to grind and polish.

In this connection, each trim strip 30 will include an intermediate part 34 which follows the contour of the intermediate part 32 of the casket shell and an outwardly extending upper rail part 36 and lower rail part 38, which follows the contours of the adjacent or opposed sectors of the upper rail 26 and bottom rail 28. The outer face 40 of the trim strip 30 may be molded with and provided with the desired configuration for aesthetic and decorative purposes which together with a metallized finish may contribute to the impression for the viewer of strength and rigidity at this location, while complimenting the remaining hardware applied to the casket 10. The inner face 42 of the trim strip 30 is recessed to provide a recess 44 defined by an inwardly projecting flange 46 extending around essentially the entire periphery of the inner face of the trim strip 30. The recess 44 of the trim strips conveniently accommodate the outwardly projecting portions of the tack weld 24. Of course, the trim strips may be of substantially any thickness and width depending upon the nature of the joint to be covered and the desired aesthetic affect to be achieved.

The present invention also contemplates the utilization and application of a resilient cushioning layer or material 50, which is preferably flexible in order to follow the inner contour of and for disposition within the recess 42 of the trim strip 30. In an at rest position layer 50 may extend beyond the flange 46, but is adapted to be compressed when applied to the shell as shown in section in FIGS. 4 and 5. The cushioning material may be utilized to dampen and eliminate vibration of the trim strip 30 and/or may be fabricated of a suitable material, as for example, a close cell foam material, to provide an air, moisture and waterproof joint 22*a* and 22*b*. Material of this type will compress and distort about the outwardly projecting portions of the tack welds 24. In accordance with a successful specific application of the present invention, the layer 50 formed of a close cell foam material, was supplied in tape form and cut from a web of a roll of such material. Each of the opposed side faces 52 and 54 of the tape 50 will preferably have a pressure sensitive adhesive surface or layer applied thereto which may be covered and protected by a release sheet or strip if necessary. Be that as it may, the adhesive layer 54 on layer surface 52 will permit the tape or strip 50 to be applied to the inner face 42 of the strip 30 in the recess 42 in order that it may closely follow the inner contour of the strip 30. The outer adhesive layer 54 performs a number of important functions including permitting the strip 30 to be attached to the shell without danger of it becoming dislodged or disassociated from the shell by falling on the ground or other surface during the ensuing manufacturation and assembly operations. Thereafter, a suitable number of screws 56 may be utilized, extending through the strip 30, layer 50 and the shell, to secure these parts together. In addition, the screw 56 when extending through the overlap connection or joint shown in FIG. 5 will add further securement of these connected parts of the shell and specifically the side panels 14 and the end panels 16 or the overlapped connections shown in FIG. 6. The adhesive surfaces of the tape 50 serve other useful and important functions including assurance that the strip 30 follows the contour of the outer contour of the shell at the joint 22*a* and 22*b* notwithstanding the effects of heat and cold and unequal expansion of the parts. In addition, this tape will reduce any permissible and undesirable flexing and movement of the trim strip 30 by assuring that the strip follows and maintains the contour of the shell. In addition, the presence of the adhesive surfaces contributes to the moisture and waterproof nature, airtightness, and hermetic seal of the joint. In this manner, the damage to the casket interior as a result of these elements will be minimized if not prevented.

Thus, it will be evident that the extensive grinding, buffing and fine finishing procedures heretofore employed in the industry at the panel joints is most effectively minimized as a result of the provision of the trim strips 30 and accompanying layer of tape 50. Each strip may be suitably contoured and finished to provide the desired aesthetic appearance in arriving at the various casket styles of each manufacturer and supplier. In this connection, trim strips 30 may be prefinished as discussed above or simply receive paint during the spray finishing operation.

With the elimination of the grinding, buffing and fine finishing operations at each of the aforenoted joints, there is a corresponding increase in production, decrease in required manual labor, decrease in noise abatement and dust from such procedures. With noise abatement and dust reduction there is a pronounced reduction in health hazards that may otherwise ensue. Needless to say, the present invention will decrease the cost in manufacturing and assembling a casket.

Thus, the aforenoted objects and advantages are most effectively attained. Although several somewhat preferred embodiments of the invention have been disclosed and described in detail herein, it should be understood that this invention is in no sense limited thereby and its scope is to be determined by that of the appended claims.

What is claimed is:

1. An improved metal casket shell comprising in combination;

a pair of spaced side panels each having opposed ends;

a pair of spaced end panels each having opposed ends;

connecting means for connecting an end of a side panel to an end of an end panel in a manner to provide at least one joint at each connection;

a trim strip extending over a part of the joint; and strengthening means association with the trim strip for increasing the strength of the joint, the end panels including rounded sections and the joint including overlapping faces of the side panel and the rounded sections that are tack welded together and the strengthening means including at least two screws extending through the overlapping faces.

2. An improved metal casket shell comprising in combination:

a pair of spaced side panels each having opposed ends;

a pair of spaced end panels each having opposed ends;

connecting means for connecting an end of a side panel to an end of an end panel in a manner to provide at least one joint at each connection;

a trim strip extending over a part of the joint; and strengthening means association with the trim strip for increasing the strength of the joint, the side panels and the end panels being straight and each corner of the casket including a corner piece that is tack welded to an adjacent end of a side panel and adjacent end of an end panel to define two of said joints at each corner having a trim strip extending thereover.

3. An improved metal casket shell comprising in combination:

a pair of spaced side panels each having opposed ends;

a pair of spaced end panels each having opposed ends;

connecting means for connecting an end of a side panel to an end of an end panel in a manner to provide at least one joint at each connection;

a trim strip extending over a part of the joint; and strengthening means association with the trim strip for increasing the strength of the joint, a tape being interposed between the trim strip and the joint, the tape cooperating in providing a hermetic seal of the joint covered by the trim strip, the tape having pressure sensitive adhesive on both side faces thereof for adhering to the inner surfaces of the trim strip and outer surfaces defining the joint to secure the trim strip to the casket shell along the joint during the assembly of the casket shell, the trim strip being recessed to receive and accommodate outwardly projecting portions at the joint and at the same time the tape.

4. The invention in accordance with claim 3, wherein the tape is a closed cell foam.

5. The invention in accordance with claim 3, wherein the tape seals the joint covered by the trim strip.

6. The invention in accordance with claim 3, wherein the strengthening means includes a layer of adhesive interposed between the inner surface of the tape and the exterior surface of the shell.

7. The invention in accordance with claim 3, wherein at least one trim strip is at each of the four corners of the casket.

8. An improved metal casket shell comprising in combination:

a pair of straight spaced side panels each having opposed ends;

a pair of straight spaced end panels each having opposed ends, an end of an end panel being adjacent and spaced from an end of a side panel to define a corner;

a corner piece at each corner of the casket shell between the adjacent ends of the end and side panels;

the corner piece being tack welded to the adjacent ends of the end panel and side panel to define a pair of joints that are spaced from one another; and a trim strip extending over a part of each joint, a tape being interposed between the trim strip and the joint, the tape cooperating in providing a hermetic seal of the joint covered by the trim strip, the tape having pressure sensitive adhesive on both side faces thereof for adhering to the inner surfaces of the trim strip and outer surfaces defining the joint to secure the trim strip to the casket shell along the joint during the assembly of the casket shell the trim strip being recessed to receive and accommodate outwardly projecting portions at the joint and at the same time the tape.

9. The invention in accordance with claim 8, wherein the tape is a closed cell foam.

10. The invention in accordance with claim 8, wherein the tape seals the joint covered by the trim strip.

11. The invention in accordance with claim 8, wherein the strengthening means includes a layer of adhesive interposed between the inner surface of the tape and the exterior surface of the shell.

12. The invention in accordance with claim 8, wherein the adjacent ends of the side panel and end panel and interposed corner piece are butt welded together.

13. The invention in accordance with claim 8, wherein the adjacent end of the side panel and corner piece are in overlapped relationship and the overlapped surfaces are tack welded together.

14. The invention in accordance with claim 13, wherein at least two screws extend through the overlapped ends to strengthen each joint.

15. An improved metal casket shell comprising in combination:

a pair of spaced straight side panels each having opposed ends;

a pair of spaced end panels each having a pair of opposed rounded corner sections with each rounded corner section having an end;

connecting means for connecting an end of the side panel to an end of the end panel to provide a joint;

a trim strip extending over the joint; and a tape being interposed between the trim strip and the joint, the tape cooperating in providing a hermetic seal of the joint covered by the trim strip, the trim strip being recessed to receive and accommodate outwardly projecting portions at the joint and at the same time the tape.

16. The invention in accordance with claim 15, wherein the adjacent ends of the side panel and end panel are welded together.

17. The invention in accordance with claim 15, wherein the adjacent ends of the side panel and end panel are in overlapped relationship and the overlapped surfaces are tack welded.

18. The invention in accordance with claim 17, wherein at least two screws extend through the overlapped ends to strengthen each joint.

19. The invention in accordance with claim 15, wherein the tape has pressure sensitive adhesive on both side faces thereof for adhering to the inner surfaces of the trim strip and outer surfaces defining the joint to secure the trim strip to the casket shell along the joint during the assembly of the casket shell.

20. The invention in accordance with claim 15, wherein the tape is a closed cell foam.

21. The invention in accordance with claim 15, wherein the tape seals the joint covered by the trim strip.

22. The invention in accordance with claim 15, wherein the strengthening means includes a layer of adhesive interposed between the inner surface of the tape and the exterior surface of the shell.

23. A joint between a side panel and an end panel of a metal casket comprising in combination:

connecting means for connecting the side panel to the end panel;

a trim strip extending over the joint between the end panel and the side panel;

a cushioning member interposed between the trim strip and the joint, the cushioning member being a tape being interposed between the trim strip and the joint, the tape cooperating in providing a hermetic seal of the joint covered by the trim strip tape having pressure sensitive adhesive on both side faces thereof for adhering to the inner surfaces of the trim strip and outer surfaces defining the joint to secure the trim strip to the casket shell along the joint during the assembly of the casket shell, the tape being a closed cell foam, the tape sealing the joint covered by the trim strip being recessed to receive and accommodate outwardly projecting portions at the joint and at the same time the tape.

24. The assembly of a trim strip and a cushioning member intimately associated with the trim strip, the trim panel and an end panel of a casket with the cushioning member being interposed between the trim strip and the joint, the cushioning member being a tape being interposed between the trim strip and the joint, the tape cooperating in providing a hermetic seal of the joint covered by the trim strip, tape having pressure sensitive adhesive on both side faces thereof for adhering to the inner surfaces of the trim strip and outer surfaces defining the joint to secure the trim strip to the casket shell along the joint during the assembly of the casket shell, the tape being a closed cell foam, the tape sealing the joint covered by the trim strip, the trim strip being recessed to receive and accommodate outwardly projecting portions at the joint and at the same time the tape.

* * * * *